US009227092B2

(12) United States Patent
Chaumontet

(10) Patent No.: US 9,227,092 B2
(45) Date of Patent: Jan. 5, 2016

(54) SAFETY ROPE BLOCKER HAVING A ROTATABLE BODY

(71) Applicant: ZEDEL, Crolles (FR)

(72) Inventor: Michael Chaumontet, Crolles (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 13/898,831

(22) Filed: May 21, 2013

(65) Prior Publication Data

US 2013/0313047 A1 Nov. 28, 2013

(30) Foreign Application Priority Data

May 22, 2012 (FR) ..... 12 01446

(51) Int. Cl.
*A62B 35/00* (2006.01)
*A62B 1/14* (2006.01)
*A63B 29/02* (2006.01)

(52) U.S. Cl.
CPC . *A62B 35/00* (2013.01); *A62B 1/14* (2013.01); *A63B 29/02* (2013.01)

(58) Field of Classification Search
CPC ..... A62B 1/14; A62B 35/00
See application file for complete search history.

(56) References Cited

U.S. PATENT DOCUMENTS

| | | | | |
|---|---|---|---|---|
| 2003/0034203 | A1 | 2/2003 | Hewlett et al. | |
| 2003/0075392 | A1 * | 4/2003 | Rogelja | 188/65.5 |
| 2008/0245611 | A1 * | 10/2008 | Klingler | 182/6 |
| 2008/0302600 | A1 * | 12/2008 | Murray | 182/5 |
| 2011/0284323 | A1 * | 11/2011 | Ayre | 182/5 |
| 2012/0111665 | A1 * | 5/2012 | Paglioli | 182/5 |
| 2013/0219671 | A1 * | 8/2013 | Hutin | 24/134 KB |

FOREIGN PATENT DOCUMENTS

| | | | |
|---|---|---|---|
| AT | 392 592 | B | 4/1991 |
| CH | 701645 | B1 * | 2/2011 |
| WO | WO 2006/035138 | A1 | 4/2006 |
| WO | WO 2012/001661 | A1 | 1/2012 |

* cited by examiner

*Primary Examiner* — Alvin Chin-Shue
(74) *Attorney, Agent, or Firm* — Oliff PLC

(57) ABSTRACT

A safety rope blocker having a body provided with a through hole for the passage of an anchoring ring and a curved groove opening into the through hole for the passage of the safety rope through the anchoring ring, the body being able to rotate between a blocking position in which the safety rope is blocked by the anchoring ring against the body and a releasing position in which the safety rope slide in the curved groove, the groove includes a deviation element to allow, in the releasing position, the safety rope to slide in the curved groove and outside the through hole.

9 Claims, 4 Drawing Sheets

A-A

A-A

SAFETY ROPE BLOCKER HAVING A ROTATABLE BODY

TECHNICAL FIELD OF THE INVENTION

The invention relates to a safety rope blocker having a rotatable body, and in particular a safety rope blocker for attaching an element to a fixed anchoring point.

In particular, the invention relates to a safety rope blocker for securing a user to a rock face or a fixed wall when mountaineering, going rock climbing or caving, or when working in a high position.

STATE OF THE ART

Currently, a safety rope can be used for securing oneself to a fixed wall or a rock face. Such a safety rope is made up of a rope generally provided, at least at one end, with an anchoring ring, for example a carabiner, in order to secure oneself to a ring anchored to the wall or the rock face, the other end being connected to the climber. These safety ropes can moreover be used to attach any type of equipment. But the length of these safety ropes is not adjustable.

There exists rope blockers, such as belaying devices marketed by the company CAMP, used to belay the upward progression of a climber by another person who is on the ground. Such a blocker includes a through hole for the passage of a carabiner and a groove opening in the first hole for a passage of the rope into the hole and through the carabiner. The carabiner is in addition attached to the harness of the person on the ground securing the climber. The rope can be blocked by wedging it between the carabiner and the blocker. For unblocking the rope, the belayer brings the two strands of the rope together, and makes the blocker swivel in order to release the carabiner and thus to free the rope. But when the rope is made to slide in order to let the rope out a bit on the climber's side, the rope rubs against the carabiner and wears out.

OBJECT OF THE INVENTION

The object of the invention is to find a solution for these drawbacks, and more particularly to provide a simple and lightweight safety rope blocker.

It is thus proposed a safety rope blocker having a body provided with a through hole for the passage of an anchoring ring and a curved groove opening into the through hole for the passage of the safety rope through the anchoring ring, the body being able to rotate between a blocking position in which the safety rope is blocked by the anchoring ring against the body and a releasing position in which the safety rope is able to slide in the curved groove.

The curved groove comprises a deviating element for allowing, in the releasing position, the safety rope to slide in the curved groove and outside the though hole.

Such a blocker allows to efficiently block the safety rope, while making it possible to adjust the length of the loaded safety rope. In particular, such a blocker makes it possible to make the safety rope slide so that it cannot rub against the anchoring ring, in order to avoid an excessive wear of the safety rope. Such a blocker is particularly adapted to secure oneself to a fixed point.

The curved groove can be configured for exerting frictions on the safety rope in order to allow the body to switch from one position into the other.

The deviation element is a wall separating the inside of the through hole and the inside of the curved groove, for allowing, in the releasing position, the anchoring ring to bear against the deviation element allowing the safety rope to slide while preventing the safety rope from rubbing against the anchoring ring.

The curved groove can comprise a first hole for a passage of the safety rope inside the body, a second hole opening into the through hole and a third hole for a passage of the safety rope outside the body, the first and third holes being separated by a separation element of the body, the separation element allowing, by a leverage effect, the rotation of the body into the releasing position when the safety rope bears against the separation element.

The curved groove can moreover comprise an opening oriented towards the outside of the body and located between the first and second holes of the curved groove.

Such an opening gives access the portion of the safety rope in the curved groove, in particular in order to make the safety rope slide more easily in the blocker body.

The body can be provided with a pulley located between the first and second holes of the curved groove.

The body can also comprise a handle for making the body rotate more easily.

The handle can comprise at least one portion partly covering the through hole so as to bear against the anchoring ring in order to decrease the effort in the handle thanks to a step-down effect.

The two strands of the safety rope can be attached to the same element.

The body can be of a single-piece type, preferably made out of metal, and for example out of aluminum.

The body can also be made from two metal sheets maintained together by means of rivets.

BRIEF DESCRIPTION OF THE DRAWINGS

Other advantages and features will more clearly arise from the following description of particular embodiments of the invention given as nonrestrictive examples and represented in the annexed drawings, in which.

DETAILED DESCRIPTION

Figure 1:
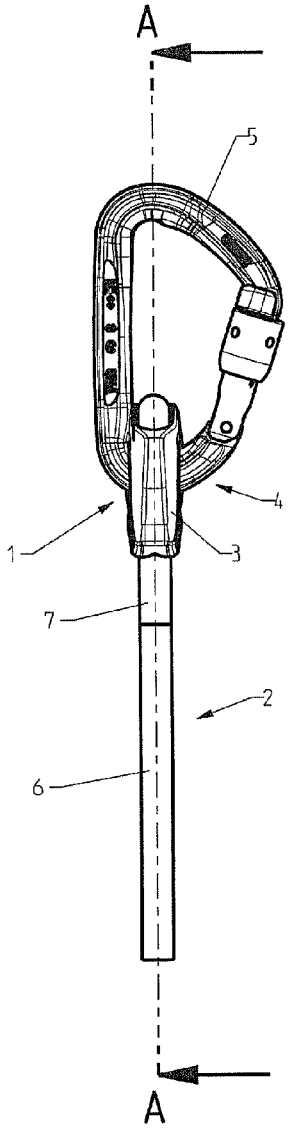
FIG. 1 schematically illustrates a prospective view of an embodiment of a safety rope blocker according to the invention.

In FIG. 1, it is schematically represented a prospective view of a blocker 1 for a safety rope 2 having a body 3 provided with a through hole 4 for the passage of an anchoring ring 5, for example a shackle and preferentially a carabiner. The body 3 of the blocker 1 is preferably made out of a metal and can be made from a cut-out, pressed and folded sheet or forged, or machined from a block of metal. In a general way, the carabiner 5 is anchored to a fixed point, a such anchoring ring fixed to a wall or any other fixed element, and at least one strand 6, 7 of the safety rope is fixed to an object to be coupled to the fixed point. The object can be a bag, or any other type of equipment, or a user, via for example a harness. The blocker 1 makes it possible to block the safety rope 2 in order to secure the user, or a piece of equipment, while making it possible to adjust the length of the safety rope, in particular to adjust the distance between the end of the strand 6 fixed to the object and the carabiner 5. In order to be able to adjust the length of the safety rope 2, the body 3 of the blocker 1 is able to rotate between a releasing position illustrated in FIGS. 2 and 3 and a blocking position illustrated in FIGS. 4, 5, 7 and 8.

Figure 2:
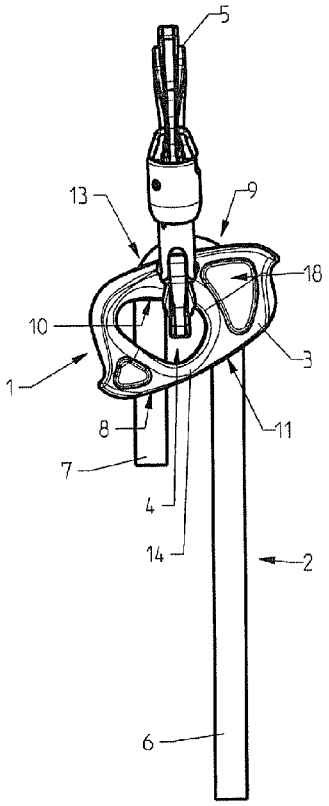
FIG. 2 schematically illustrates a front view of the safety rope blocker in FIG. 1 in the releasing position.
Figure 3:
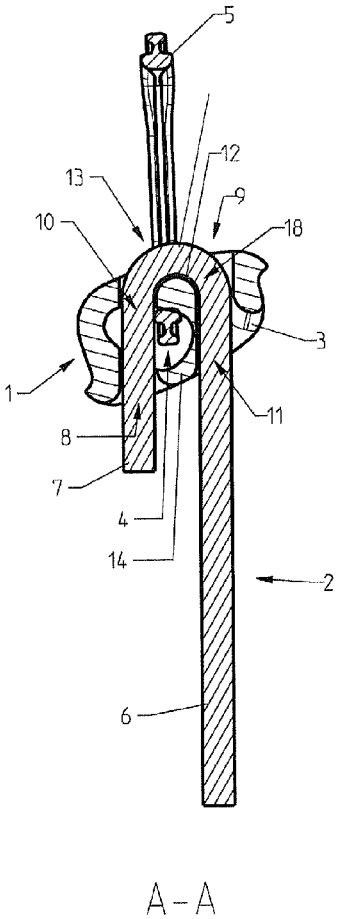
FIG. 3 schematically illustrates a cross-section, along the axis A-A in FIG. 1, of the safety rope blocker in the releasing position.

In FIGS. 2 and 3, it is schematically represented a front view of the blocker 1 for a safety rope 2 in the releasing position. In particular, FIG. 3 is a cross-section along the axis A-A in FIG. 1. Some references of the elements, previously described in FIG. 1, are also indicated in the Figures. The body 3 of the blocker 1 moreover comprises a groove 9 for guiding the safety rope inside the body 3, so that the safety rope 2 passes through the through hole 4 and through the carabiner 5. In particular, the groove 9 allows the safety rope 2 to slide outside the through hole 4, in other words around the through hole 4. The groove 9 comprises a first hole 11 for a passage of the safety rope inside the body 3, a second hole 10 opening into the through hole 4 and a third hole 8 opening towards the outside of the body 3. Moreover, the groove 9 comprises a portion 18 located between the first and second holes 11, 10 of the groove 9. The portion is curved towards the through hole 4. Preferably, the groove 9 has on the whole a U-shape. The through hole 4 and the holes 11, 10, 8 of the groove 9 have on the whole a cylindrical shape. The through hole 4 can have an ovoid shape. The through hole 4 comprises a main axis substantially perpendicular to the longitudinal plane of the body 3 (i.e. in the cutting plane along the axis A-A). The first, second and third holes 11, 10, 8 are substantially perpendicular to the through hole 4. Thus, the safety rope 2 enters the body 3 through the first hole 11, passes into the curved portion 18 of the groove 9, through the second hole 10, and then inside the through hole 4 in a direction perpendicular to the main axis of the through hole 4. Then the safety rope 2 goes through the third hole 8 of the groove 9 and goes out of the body 3 of the blocker 1. The groove 9 is oriented so that the safety rope 2 passes around the through hole 4. In particular, the curved portion 18 of the groove 9 comprises a deviation element 12. Preferably, the deviation element 12 can be a wall separating the inside of the through hole 4 and the inside of the curved portion 18 of the groove 9. The wall forms a bearing surface 12 between the safety rope 2 and the carabiner 5. In particular, the bearing surface 12 is facing the inside of the through hole 4. According to an embodiment, the curved portion 18 can be entirely closed within the body 3 over its length and opened only at the first and second holes 11, 10. According to another embodiment, the curved portion 18 of the groove 9 can comprise an opening 13 oriented towards the outside of the body 3 for having access to the safety rope 2, in particular in order that the safety rope 2 can slide more easily in the groove 9.

In a general way, it can be noted that the third hole 8 and the first hole 11 of the groove 9 are located on the same face of the body 3, and on both sides of the through hole 4. Moreover, the body 3 can include a separation element 14 located between the third hole 8 and the first hole 11 of the groove 9. In a variant, the body 3 can include a single hole forming both the first and third holes 11, 8 of the groove 9. In this variant, the body 3 does not include such a separation element 14.

The body 3 of the blocker 1 is able to rotate around the main axis of the through hole 4, i.e. around an axis of rotation substantially perpendicular to the through hole 4. In a general way, the body 3 is able to rotate between a blocking position in which the safety rope 2 is blocked by the carabiner 5 against the body 3 and a releasing position in which the safety rope 2 slides in the groove 9.

In the releasing position, the safety rope 2 slides in the groove 9 of the body 3 of the blocker 1, in particular in the curved portion 18 of the groove 9 and through the third hole 8. In this position, the user can make the safety rope 2 slide by drawing one of the strands 6, 7 thereof. The sliding motion can moreover be facilitated by the deviation element 12. Indeed, when the carabiner 5 bears against the deviation element 12, the user can easily make the safety rope 2 slide by drawing only the strand having the reference 7, also called the loose strand. In particular, the deviation element 12 makes it possible to make the safety rope 2 slide when a weight is fixed to the end of the other strand having the reference 6, also called the safety strand. When drawing the loose strand 7, one shortens the length of the safety strand 6 between the weight and the carabiner 5. One can also increase the length of the safety strand 6 by slackening the tension on the loose strand 7, maintaining the body 3 in the releasing position, and drawing the safety strand 6. One can thus adjust the length of the safety rope 2. In other words, one can reduce the length of the safety strand 6 when under tension, i.e. when loaded, by drawing the loose strand 7. One can increase the length of the safety strand 6 when it is not any more under tension. One can also adjust the lengths of the two strands 6, 7 of the safety rope 2, by removing the weight from each end of the strands 6, 7 so that each strand 6, 7 is not any more under tension. In particular, the deviation element 12 allows the safety rope 2 to slide while preventing it from rubbing against the carabiner 5.

Figure 4:
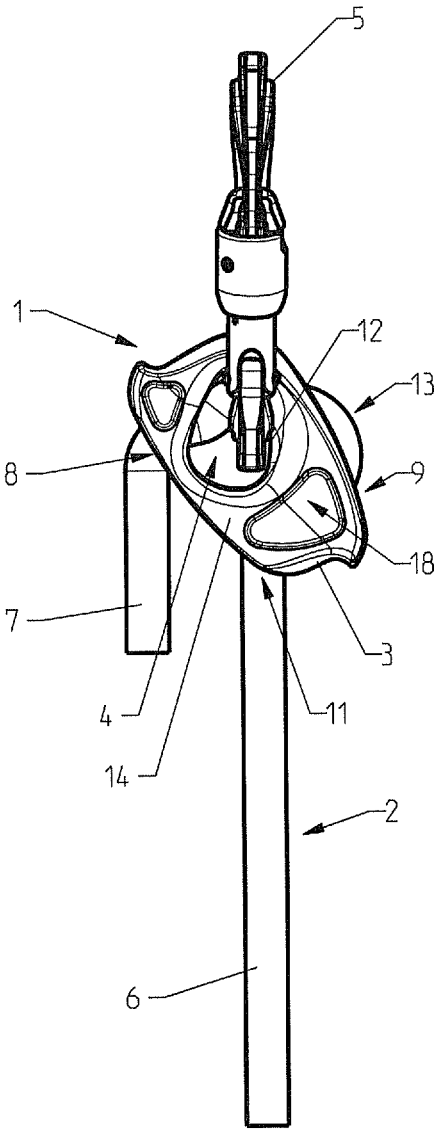
FIG. 4 schematically illustrates a front view of the safety rope blocker in FIG. 1 in the blocking position.
Figure 5:
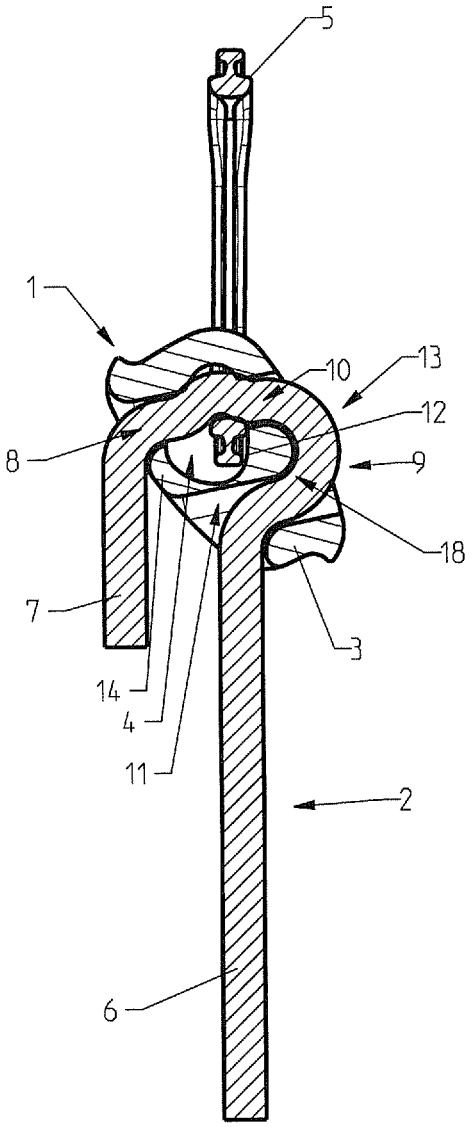
FIG. 5 schematically illustrates a cross-section, along the axis A-A in FIG. 1, of the safety rope blocker in the blocking position.

In FIGS. 4 and 5, it is schematically represented a front view of the blocker 1 of the safety rope 2 in the blocking position. In particular, FIG. 5 is a cross-section along the axis A-A in FIG. 1. In the figures are also indicated some references of the elements, described to the preceding figures. In the blocking position, the carabiner 5 wedges the safety rope 2 against the body 3 of the blocker 1, in particular against an edge of the through hole 4 between the third hole 8 and the second hole 10 of the groove 9. In addition, the carabiner 5 is facing the deviation element 12 and does not bear against it. In the blocking position, the safety rope 2 does not slide, and the safety strand 6 is under tension and ensures that an object is safely fixed to the anchoring ring. Moreover, the loose strand 7 can be fixed to the object, because this object is not under tension.

The rotation of the body 3 of the blocker 1 allows the passage from the blocking position into the releasing position and conversely. For switching from the blocking position into the releasing position, the user draws the loose strand 7 of the safety rope 2, and the body 3 swings by bearing against the carabiner 5 at the deviation element 12. The body 3 rotates around its axis of rotation up to the releasing position in which the carabiner 5 bears against the deviation element 12 and does not wedge the safety rope 2 any more against the body 3. The rotation of the body 3 releases the carabiner 5 which is no more in contact with the safety rope 2. Thus, in the releasing position, the safety rope 2 slides without rubbing against the carabiner 5, which limits the wear of the safety rope 2. For switching into the releasing position the rotation of the body 3 can be carried out in full load, i.e. with the safety strand 6 under tension. Moreover, the groove 9 forms a baffle for the safety rope 2, and generates frictions on the safety rope 2 in order to facilitate the rotation of the body from one position into the other. In particular, the deviation element 12 allows a first leverage effect cooperating with the friction generated by the groove 9 on the safety rope 2, in order to make the body 3 switch into blocking position more easily. In addition, the separation element 14 facilitates the passage into the releasing position by allowing the loose strand 7 to bear on the separation element 14 in order to generate a second opposite leverage effect from the first one.

For switching from the releasing position into the blocking position, the user slackens the loose strand 7 of the safety rope 2, and draws the safety strand 6. Thus, the body 3 automatically swings by bearing against the carabiner 5, at the deviation element 12 of the groove 9, due to the weight maintaining the safety strand 6 under tension. The body 3 rotates around its axis of rotation up to the blocking position in which the carabiner 5 bears against the safety rope 2 and wedges it against the body 3.

Figure 6:
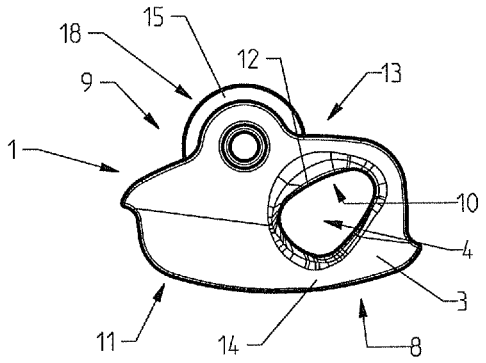
FIG. 6 schematically illustrates a back view of another embodiment of the safety rope blocker according to the invention.

In FIG. 6, it is schematically represented a back view of a blocker 1 of the safety rope according to another embodiment. In this other embodiment, the body 3 comprises a pulley 15 located in the groove 9, in particular in the curved portion 18, in order to make the safety rope 2 slide more easily.

Figure 7:
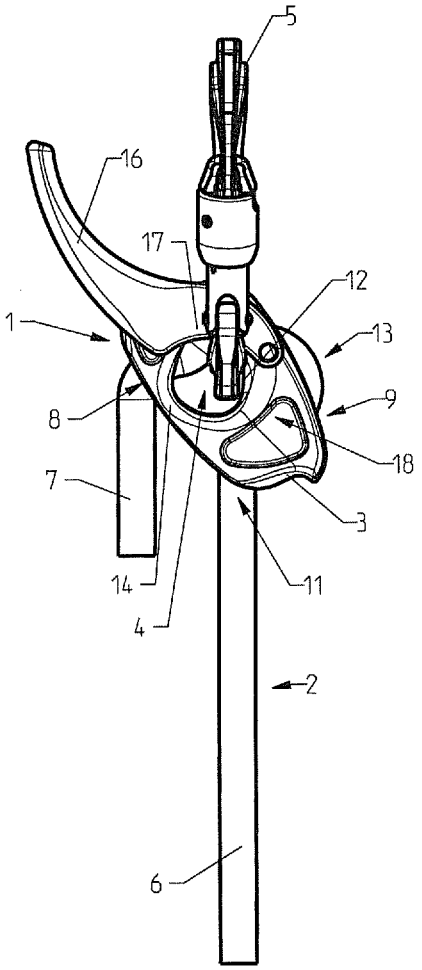
FIGS. 7 and 8 schematically illustrates front views of other embodiments of the safety rope blocker in the blocking position.
Figure 8:
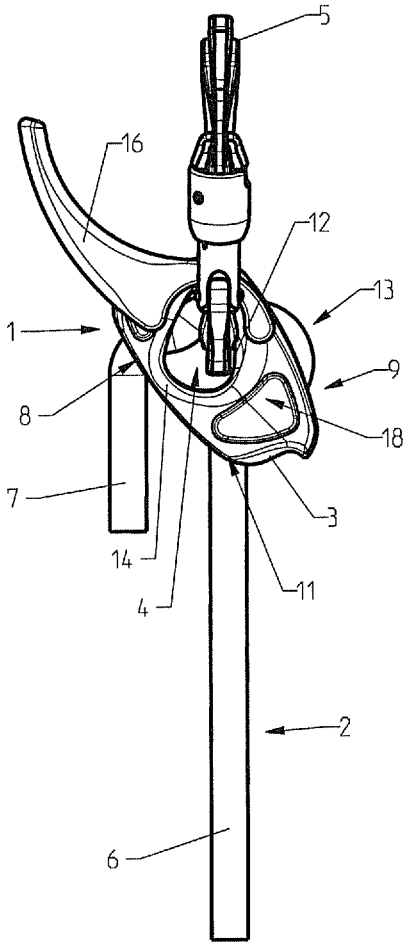

FIGS. 7 and 8 schematically illustrate front views of other embodiments of a blocker 1 of the safety rope 2. According to an embodiment illustrated in FIG. 8, the blocker 1 comprises a handle 16 projecting from the body 3 in order to facilitate the rotation thereof. Preferentially, the handle 16 is located on the side of the third hole 8, i.e. of the loose strand 7. According to another embodiment, illustrated in FIG. 7, the handle 16 comprises a portion 17 partly covering the through hole 4 so as to bear against the carabiner 5 in order to reduce the efforts applied to the carabiner 5 by the body 3 during the rotation thereof.

Figure 9:
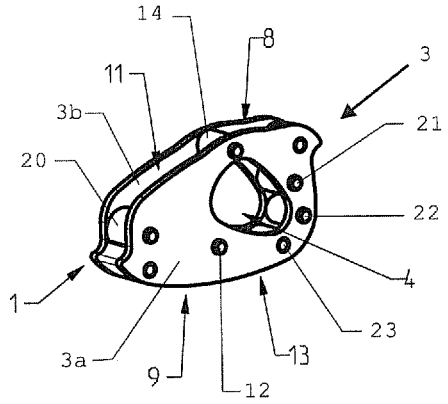
FIGS. 9 and 10 schematically illustrate a prospective view and a cross-section, respectively, of another embodiment of the safety rope blocker according to the invention.
Figure 10:
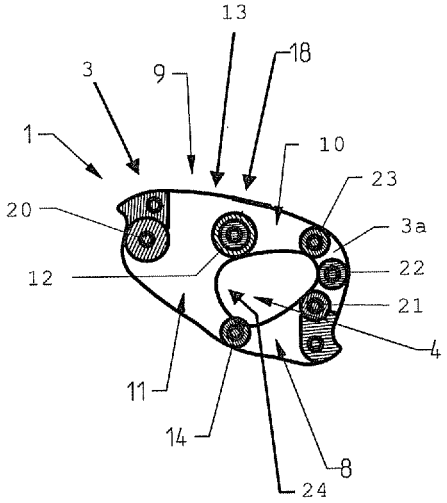

In FIGS. 9 and 10 it is also illustrated another embodiment of a safety rope blocker 1 according to the invention. In this other embodiment, the body 3 of the blocker is made of two sheets 3*a*, 3*b* maintained together by rivets 12, 14, 20 to 23. For example, the body 3 can include two rivets 20, 21 located at the ends of the body 3, respectively. In particular the rivet having the reference 12 forms the deviation element. In this case the deviation element 12 can be a rod having on the whole a cylindrical shape. For example the body 3 can include a rivet having the reference 14 forming the separation element. Moreover, the groove 9 can include an additional opening 24 for a communication between the inside of the through hole 4 and the inside of the groove 9. The additional opening 24 is located between the deviation element 12 and the separation element 14.

Thus, it is provided an adjustable safety rope blocker configured for anchoring any type of object at a fixed point while allowing to the adjustment of the length of the safety rope. Such a blocker is simple to use and is particularly compact.

The invention claimed is:

1. A safety rope blocker comprising:

a body that includes:

a through hole for the passage of an anchoring ring; and a curved groove comprising:

a first hole for a passage of a safety rope inside the body;

a second hole opening into the through hole for the passage of the safety rope through the anchoring ring; and a third hole for a passage of the safety rope outside the body; wherein:

the curved groove includes a deviation element being a wall separating an inside of the through hole and an inside of the curved groove, allowing the body to rotate by bearing against the anchoring ring at the deviation element between a blocking position in which the safety rope is blocked by the anchoring ring against the body and not the deviation element, and a releasing position in which the deviation element allows the anchoring ring to bear against the deviation element and not the rest of the body so that the safety rope slides in the curved groove and outside the through hole, and the body including a separation element separating the first and third holes, the separation element and the deviation element being located on two opposite edges of the through hole creating a space located between the deviation element and the separation element for receiving the anchoring ring when the body is in the releasing position preventing the safety rope from rubbing against the anchoring ring.

2. The safety rope blocker according to claim 1, wherein the curved groove is configured for exerting frictions on the safety rope in order to allow the body to switch from one position into the other.

3. The safety rope blocker according to claim 1, wherein the separation element allowing, by a leverage effect, the rotation of the body into the releasing position when the safety rope bears against the separation element.

4. The safety rope blocker according to claim 3, wherein the curved groove moreover comprises an opening oriented towards the outside of the body and located between the first and second holes of the curved groove.

5. The safety rope blocker according to claim 3, wherein the body is provided with a pulley located between the first and second holes of the curved groove.

6. The safety rope blocker according to claim 1, wherein the body comprises a handle for making the body rotate more easily.

7. The safety rope blocker according to claim 6, wherein the handle comprises at least one portion partly covering the through hole so as to bear against the anchoring ring.

8. The safety rope blocker according to claim 1, wherein the body is of a single-piece type.

9. The safety rope blocker according to claim 1, wherein the body is made of two sheets maintained together by rivets.

* * * * *